US010544575B1

(12) United States Patent
DiTullio

(10) Patent No.: US 10,544,575 B1
(45) Date of Patent: Jan. 28, 2020

(54) WATER STORAGE CHAMBER CONNECTION SYSTEM

(71) Applicant: Robert J. DiTullio, Brookfield, CT (US)

(72) Inventor: Robert J. DiTullio, Brookfield, CT (US)

( * ) Notice: Subject to any disclaimer, the term of this patent is extended or adjusted under 35 U.S.C. 154(b) by 0 days.

(21) Appl. No.: 16/026,851

(22) Filed: Jul. 3, 2018

(51) Int. Cl.
*E03F 1/00* (2006.01)
*E02B 11/00* (2006.01)
*E02B 13/00* (2006.01)

(52) U.S. Cl.
CPC ..... *E03F 1/003* (2013.01); *E02B 11/005* (2013.01)

(58) Field of Classification Search
CPC ..... E02B 11/00; E02B 11/005; E03F 1/003
USPC ..... 405/36, 43, 46, 49, 50, 124, 126
See application file for complete search history.

(56) References Cited

U.S. PATENT DOCUMENTS 5,087,151 A 2/1992 DiTullio
5,511,903 A * 4/1996 Nichols ..... E03F 1/003 405/36
5,890,838 A * 4/1999 Moore, Jr. ..... E03F 1/003 405/43
6,698,975 B1 * 3/2004 Benecke ..... E03F 1/003 405/43
7,226,241 B2 6/2007 DiTullio
7,364,384 B1 * 4/2008 Swistak ..... E03F 1/003 405/43
7,611,306 B1 * 11/2009 Hallahan ..... E03F 1/003 405/46
8,366,346 B2 * 2/2013 DiTullio ..... E03F 1/003 405/43
8,425,148 B2 4/2013 DiTullio
2005/0074285 A1 * 4/2005 Burnes ..... E03F 1/003 405/43
2005/0111915 A1 * 5/2005 Moore, Jr. ..... E03F 1/003 405/46
2007/0077122 A1 * 4/2007 Birchler ..... E03F 1/003 405/46
2007/0081860 A1 * 4/2007 Goddard ..... E03F 1/003 405/49
2014/0007946 A1 * 1/2014 Koncelik, Jr. ..... F17D 1/00 137/15.01

* cited by examiner

*Primary Examiner* — Frederick L Lagman
*Assistant Examiner* — Stacy N Lawson
(74) *Attorney, Agent, or Firm* — St Onge Steward Johnston & Reens LLC

(57) ABSTRACT

A water detention chamber, and a system constructed from multiple such chambers, is an arch-shaped corrugated chamber having a flange having an upper surface and a lower surface. The lower surface of the flange has one or more protrusions, preferably elongated members, at the first end of the chamber. The upper surface of the flange has one or more mating apertures or cavities formed therein. Multiple such chambers can be connected to each other in an end-to-end fashion with protrusions at the first ends of a chamber engaged with apertures or cavities at the second ends of a second chamber.

19 Claims, 14 Drawing Sheets

WATER STORAGE CHAMBER CONNECTION SYSTEM

FIELD OF THE INVENTION

This application relates generally to molded plastic chambers for water detention and, more particularly to a connection system for open bottomed, arch-shaped molded plastic chambers adapted to receive storm water runoff.

BACKGROUND OF THE INVENTION

Storm water runoff collected from roof areas and paved areas were historically directed into municipal storm water drainage systems and released into a local body of water. However, regulatory changes and good practice now mandate that storm water runoff must be collected and directed to local soil where it can replenish groundwater supplies.

The traditional construction of storm water handling systems has been concrete tanks or infiltration trenches filled with large gravel or crushed stone with perforated pipes running therethrough. Such stone filled trench systems are non-economical and/or inefficient since the stone occupies a substantial volume, limiting the ability of the system to handle large surge volumes associated with heavy storms. Both the stone and the perforated pipe are also susceptible to clogging by particles or debris carried by water.

Molded plastic chamber structures were introduced to the market to take the place of concrete structures for handling storm water. U.S. Pat. No. 5,087,151 is an early patent in the field which discloses a drainage and leaching field system comprising vacuum-molded polyethylene chambers that are designed to be connected and locked together in an end-to-end fashion to provide a water handling system.

Storm water chambers typically have a corrugated arch-shaped cross-section and are relatively long with open bottoms for dispersing water to the ground. The chambers are typically buried within crushed stone aggregate or other water permeable granular medium that typically has 20-40 percent or more void space. The chambers serve as water reservoirs in a system that includes both the chambers and surrounding crushed stone. The crushed stone is located beneath, around, and above the chambers and acts in combination with the chambers to provide paths for water to percolate into the soil, and also provides a surrounding structure that bears the load of any overlying materials and vehicles. The chambers will usually be laid on a crushed stone bed side-by-side in parallel rows, then covered with additional crushed stone to create large drainage systems. End portions of the chambers may be connected to a catch basin, typically through a pipe network, in order to efficiently distribute high velocity storm water. Examples of such systems are illustrated in U.S. Pat. Nos. 7,226,241 and 8,425,148.

The use of molded plastic chamber structures has grown substantially since their initial introduction to the market, and have replaced the use of concrete structures in many applications. Molded plastic chamber structures provide a number of distinct advantages over traditional concrete tanks or stone-filled trench systems. For example, concrete tanks are extremely heavy requiring heavy construction equipment to put them in place. Stone-filled trench systems are expensive and inefficient since the stone occupies a substantial volume, limiting the ability of the system to handle large surge volumes of water associated with heavy storms.

More recently, manufacturers have begun to offer taller; bigger volume chambers having a larger storage capacity. A design consideration associated with larger size storm water chambers is that such structures may experience greater load stress than smaller chambers. A chamber should have a load bearing strength capable of bearing the load of the overlaying crushed stone and paving, and loads corresponding to use of construction equipment and vehicular traffic over the location of the buried chamber.

Various features have been incorporated into the structure of storm water chamber including the use of sub-corrugations into the corrugations so as to improve the strength of the plastic storm water chambers. While some of the proposed configurations have improved storm water chambers construction, there is still a need to improve the structural rigidity of multiple chambers that are connected to each other to form a field of chambers.

For example, one problem encountered by plastic storm water chambers during installation is that of the upright sides spreading apart relative to each other. It is typical for storm water chamber installations to occur during hot summer months when solar heating of the chambers is a significant problem, particularly in southern latitudes. As the plastic storm water chambers sit on the jobsite prior to installation, they absorb solar energy, which heats the plastic chambers, lowering the rigidity of the structures. When these heated plastic chambers are finally lowered into place in the bottom of a trench, the upstanding side walls can become relatively pliable causing them to spread apart from each other. This is especially a problem when crushed stone is dropped into the trench around and on top of the plastic chamber. The weight of the stone combined with the increased pliability of the plastic chamber can, in some instances, cause deformation or collapse of the chamber.

Therefore, there continues to be a need in the storm water management field for plastic storm water chambers that have structural elements to offset or negate the reduced rigidity of the upstanding side walls when rigidity is reduced due to, for example, solar heating.

SUMMARY OF THE INVENTION

Accordingly, it is an object of the present invention to provide a storm water chamber that functions to resist allowing the upstanding sidewalls of a plastic storm water chamber from spreading apart from each if rigidity is reduced due to, for example, solar heating of the chamber It is also desired to provide a storm water chamber holds the ends of the upstanding side walls of a first storm water chamber adjacent to the ends of the upstanding side walls of a second storm water chamber.

It is still further desired to provide a first storm water chamber having upstanding side walls that are fixed in position relative to upstanding side walls of a second storm water chamber.

These and other objectives are achieved by providing a first and a second plastic arch-shaped corrugated chamber each having upstanding side walls, the length of the upstanding side walls defined by a first end and a second end. The upstanding side walls each have a flange extending substantially perpendicular to a bottom edge of each upstanding side wall. The flange at the first end have protrusions, preferably elongated linear protrusions, extending from an underside of the flange. The flange at the second end has mating apertures or cavities formed in an upper side of the flange. The first end of the first chamber is adapted to be seated on the second end of the second chamber such that the protrusions on the flange of the first chamber fits into the apertures or cavities in the flange of the second chamber.

In this manner, the first end of the first chamber fits over top of the second end of the second chamber, where the protrusions on the first chamber can snap into place or lock into the apertures or cavities to hold the upstanding side walls of the first chamber firmly seated on (overlying) the upstanding side walls of the second chamber. The protrusions could be held via a friction fit, or could be shaped or formed such that the aperture or cavity formed in the plastic flange deforms to allow the protrusion to fit therein and snaps into place as the protrusion could be formed with, for example, an undercut or the like.

It is common to provide the plastic storm water chambers with a plurality of corrugations along the length of the chamber, including running down the sides of the upstanding side walls to the flange. The chambers could be formed such that an end rib at the second end of the second chamber is smaller in size than the end rib at the first end of the first chamber such that the end rib of the first chamber can be fit over the end rib of the second chamber in an end-to-end fashion. It is further contemplated that the end rib configurations would be provided such that the protrusions on the flange of the first chamber lines up with the apertures or cavities in the flange of the second chamber. To install the two chambers, the second chamber is placed within the trench and the first is placed with the end rib overlapping the end rib of the second chamber. The installer need only step on the top of the flange of the first chamber to snap the protrusions into the apertures or cavities.

Once the first and second chambers are "locked" in to each other, this will function to prevent the upstanding side walls from spreading relative to each other as the thickness of the sidewalls will effectively be doubled due to the over lapping nature of the walls. Likewise, the bottom edges of the first chamber upstanding side walls will be locked down onto the second chamber upstanding side walls such that no openings will be formed between the two chambers preventing any stone or other debris from wedging in between the two chambers.

In one configuration, the flange end that includes the downward facing protrusion is formed with an undercut and the flange end that includes the upward facing aperture or cavity is likewise formed with an undercut. In this manner when the first chamber is laid over top of and nested against the second chamber and the protrusion is locked into place in the cavity, both the top and bottom edges of the flanges of the first and second chambers are substantially flush with each other.

As was stated previously, the upstanding sidewalls will typically include a plurality of corrugations that are positioned along a length of the plastic storm water chamber. The configuration of the corrugations can vary widely and include any number of differing reinforcing ribs provided in conjunction with the corrugations.

In one configuration it is contemplated that at the base of each corrugation where the corrugation meets the flange, a stacking lug may be positioned extending from a lower end of the corrugation to the flange. In one embodiment, the stacking lug will be positioned substantially perpendicular to the flange and can be formed to provide an upward facing edge. During storage and transit, it is contemplated that the plastic storm water chambers may be stacked in manner where one is placed over top of the another allowing for many chambers to be nested and stacked. However, to prevent the chambers from becoming stuck (tightly nested) to each other from the weight of them being stacked, it is contemplated that when one chamber is stacked on top of another chamber, the bottom edge of the flange of the top chamber will sit on top of the upward facing edge of the stacking lug of the bottom chamber. This configuration will prevent the corrugations becoming very tightly stuck to each other.

In one embodiment, the upward facing edge of the stacking lug will be formed having two edges at differing elevations relative to each other. In one configuration, the upward facing edge of the stacking lug extending from face of the corrugation will be formed at a first distance (d1) relative to the upper surface of the flange, and the upward facing edge of the stacking lug farther from the face of the corrugation will be formed at a second distance (d2) relative to the upper surface of the flange. It is contemplated that the second distance (d2) will be a larger than the first distance (d1).

It will be noted that the stacking lug will typically not be present on the last corrugation at either the first or second end of a storm water chamber. In any event, it will be evident that the stacking lug will never be present at the second end of a chamber as that corrugation is designed to be overlaid by end corrugation of an adjacent chamber when installed in an end-to-end fashion.

Another function of the stacking lugs beyond preventing stacked chambers from being stuck to each other is to provide reinforcement between a corrugation and the flange as the stacking lug will run from the bottom edge of the corrugation for a length of the corrugation and will run from the edge of the flange connected to the corrugation along a lateral distance of the flange. This will function to make the connection between the corrugation and the flange more rigid and increase structural integrity of the plastic storm water chamber.

In one configuration the flange is provided with an upstanding or raised portion along the outer edge of the flange. In another configuration the protrusion comprises an elongated piece of material and the cavity comprises an elongated opening formed as a slot for receiving the elongated protrusion. The protraction may be formed was a substantially rectangular piece that fits into a substantially rectangular slot and is maintained by a frictional fit. Alternatively, the elongated protrusion could be formed as a trapezoid-shaped object having tapered edges with a correspondingly shaped elongated slot, which could be held by a friction fit. Still further, the elongated protrusion could be with an end having a width that is wider at an end part than at a base part such that the protrusion causes the cavity to deform to pass through and is mechanically interlocked when assembled. Yet further, the protrusion could be angled on one side (e.g., angled toward an outer edge of the flange such that the protrusion is formed as an elongated parallelogram) where the opposing side is formed as an elongated rectangle. In this configuration, the angled member side would be inserted into the corresponding slot first and then the chamber would be laterally rotated downward to seat the angled elongated protrusion into the slot and then the opposing side would be seated straight downward to affix the opposing protrusion into the opposing slot. In one configuration, the angled protrusion would be formed as a parallelogram and the opposing protrusion would be formed with an undercut or the like such that opposing protrusion will lock into place effectively locking the two plastic storm water chambers to each other.

The chamber may be formed by injection molding or by a molded plastic sheet.

In one configuration a water detention system is provided comprising a plastic arch-shaped corrugated chamber having corrugations distributed along a length of the chamber extending transverse to a longitudinal axis of the chamber, the chamber having a top portion and two side portions, with a base at a lower end of each side portion, the chamber length defined by a first end and a second end. The chamber further comprising a flange provided at the base of each lower end of each side portion, the flange extending substantially perpendicular to the lower end of each side portion and having an upper surface and a lower surface. The chamber is provided such that the lower surface of the flange at the first end includes a protrusion and the upper surface of the flange at the second end includes an aperture or cavity formed therein.

In another configuration a method of manufacturing a water detention system is provided comprising steps of providing a polymer melt, injecting a CO2 blowing agent into the polymer melt and injecting the polymer melt and CO2 blowing agent blend into a mold cavity, the mold cavity defining an arch-shaped corrugated chamber having corrugations distributed along a length of the chamber extending transverse to a longitudinal axis of the chamber, the chamber having a top portion and two side portions, with a base at a lower end of each side portion, the chamber length defined by a first end and a second end, the mold cavity further defining a flange provided at the base of each lower end of each side portion, said flange extending substantially perpendicular to the lower end of each side portion and having an upper surface and a lower surface with the lower surface of said flange at the first end including a protrusion and the upper surface of said flange at the second end including an aperture or cavity formed therein.

Other objects of the invention and its particular features and advantages will become more apparent from consideration of the following drawings and accompanying detailed description.

BRIEF DESCRIPTION OF THE DRAWINGS

FIG. 30 is an alternative construction for the protrusion and aperture or cavity according to FIG. 3.

DETAILED DESCRIPTION OF THE INVENTION

Figure 1:
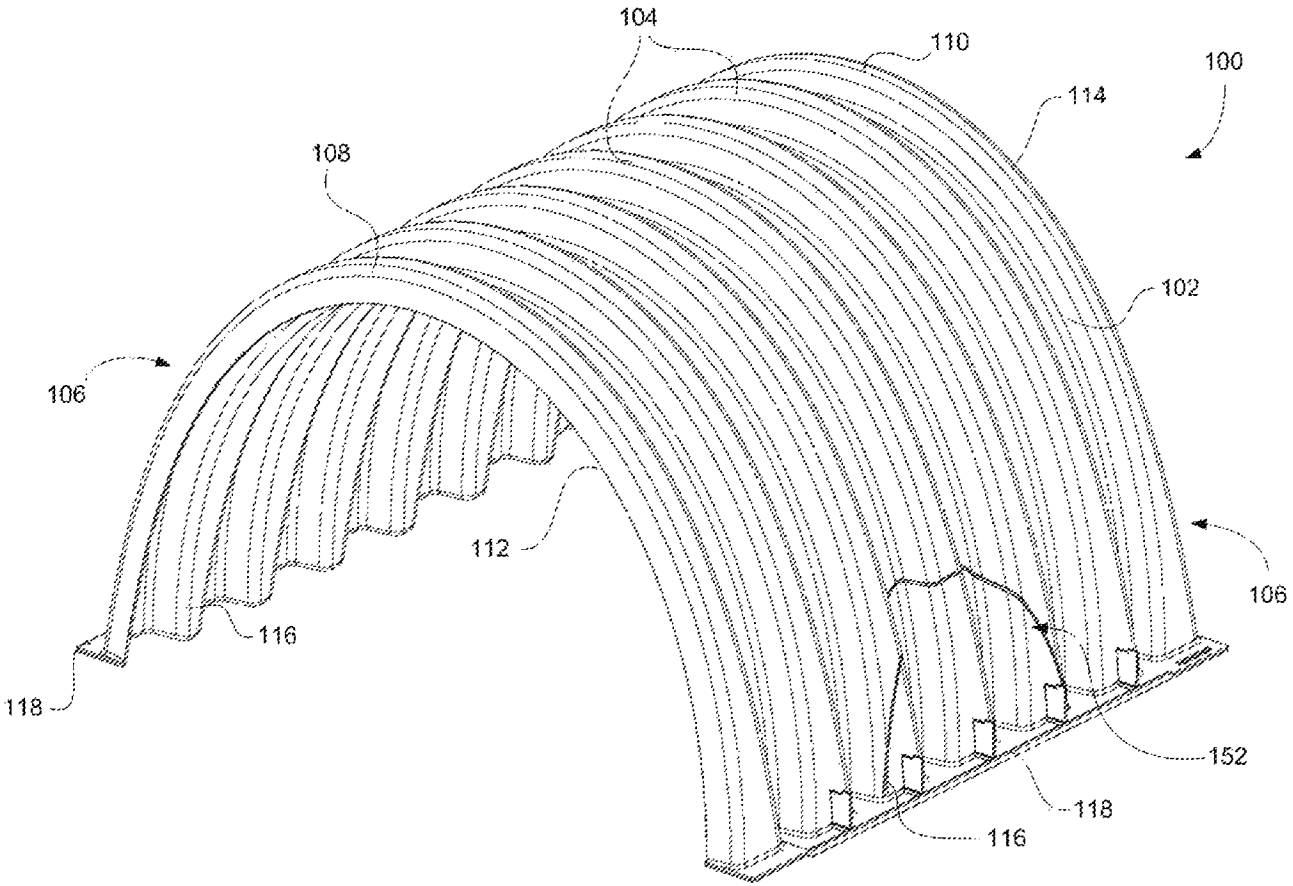
FIG. 1 is a perspective view of a storm water chamber in according to the invention.

Referring now to the drawings, wherein like reference numerals designate corresponding structure throughout the views.

FIG. 1 is an illustration of a chamber 100 generally comprising an arch-shaped body portion 102 that includes a plurality of upstanding corrugations 104. The body portion 12 is provided with an open bottom such that side walls 106 are configured to rest on the surface of the bed of materials. Chamber 100 may be provided with a starting corrugation 108, which is designed to mate with an end corrugation 110 when chambers are connected in an end-to-end fashion.

Figure 2:
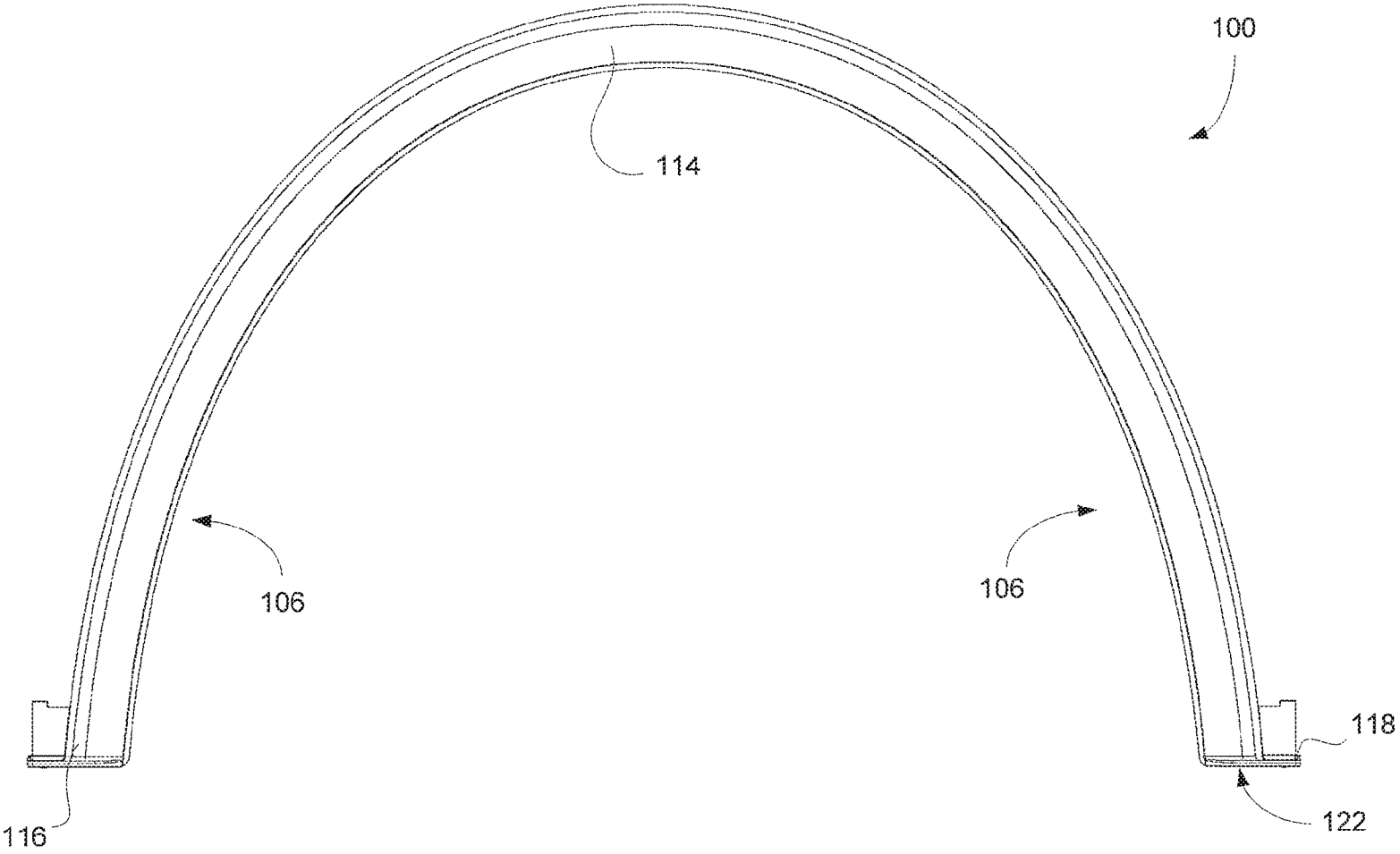
FIG. 2 is an elevation view of the second end of the chamber according to FIG. 1.
Figure 3:
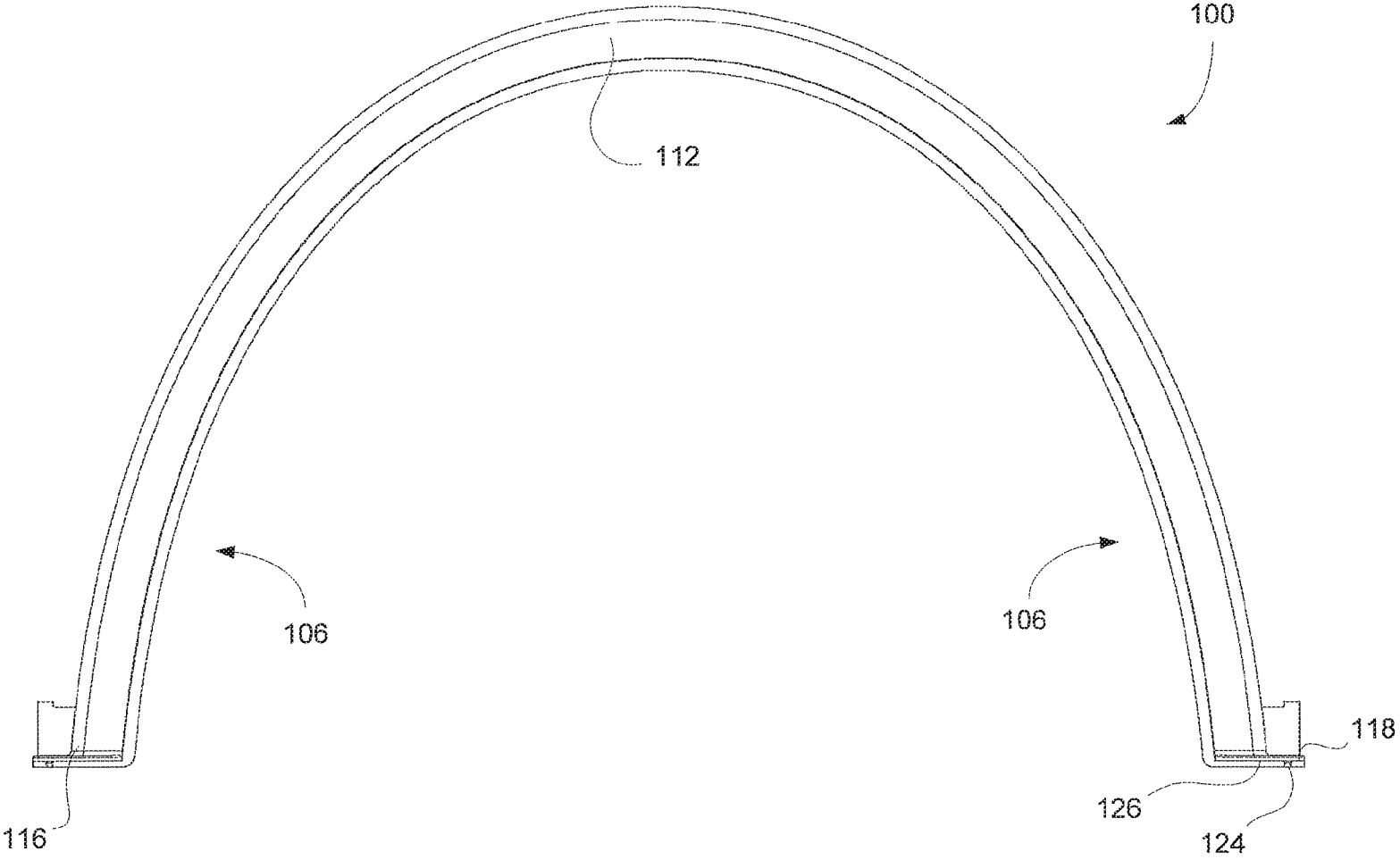
FIG. 3 is an elevation view of the first end of the water chamber according to FIG. 1.
Figure 3A:
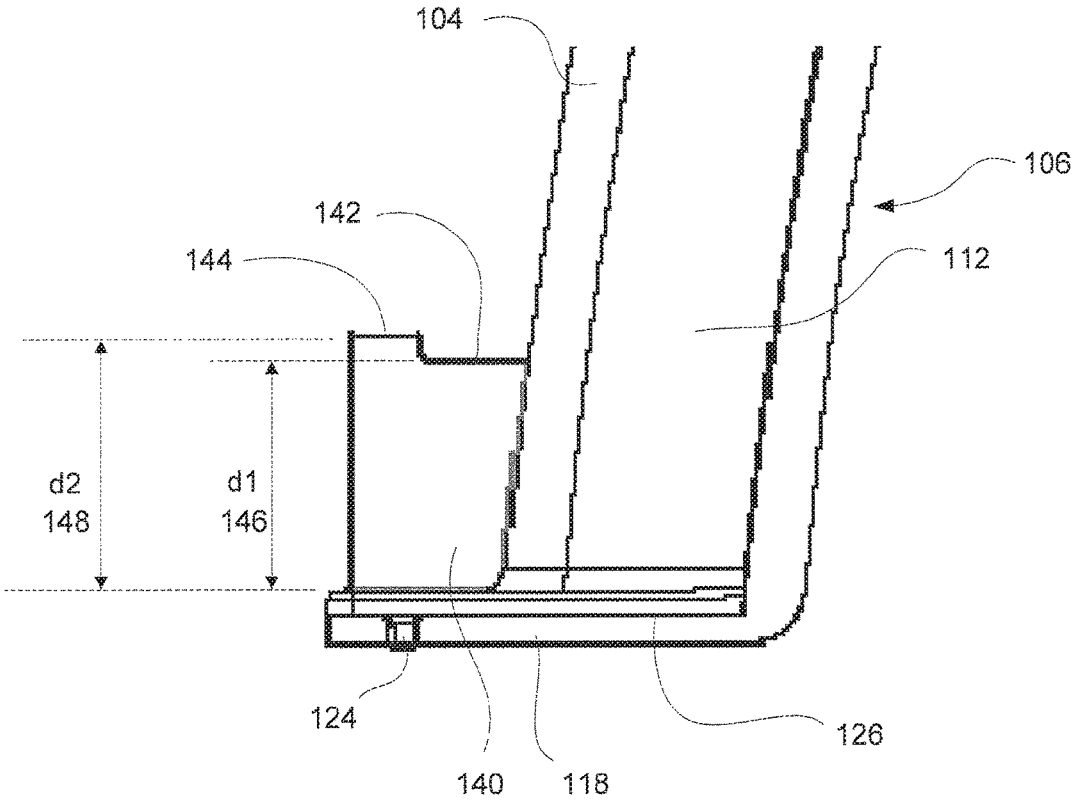
FIG. 3A is an enlarged view according to FIG. 3.
Figure 6:
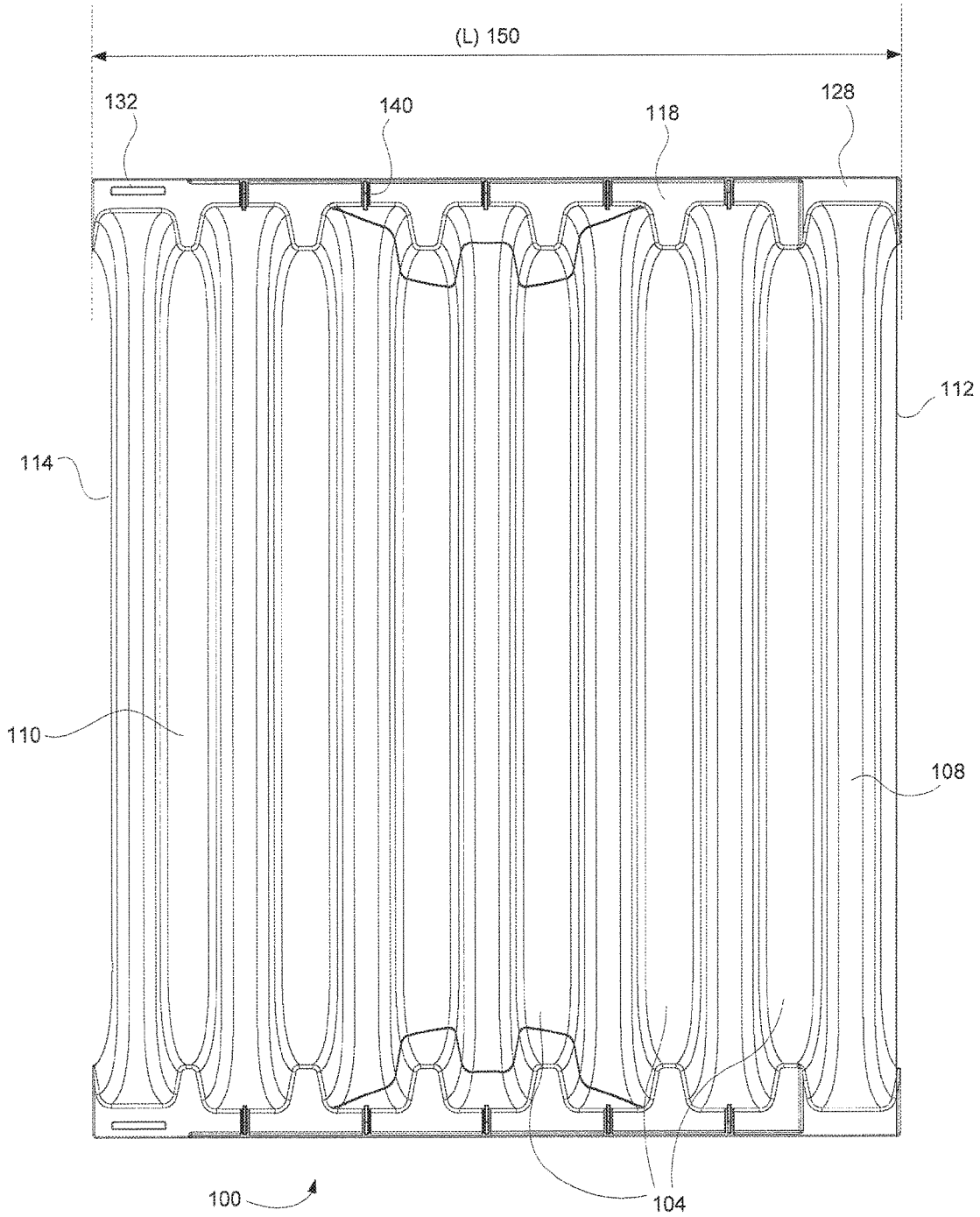
FIG. 6 is a top plan view of the storm water chamber according to FIG. 1.

A longitudinal length (L) 150 (FIGS. 4 & 6) of the chamber 100 is defined by a first end 112 and a second end 114. The upstanding corrugations 104 follow the arched shape of the chamber and terminate at a lower end 116 of side walls 106 (FIG. 1). A flange 118 extends at the lower end 116 of side walls 106 from the second end 114 and extends toward the first end 112. The flange 118 is provided extending generally perpendicular from the lower end 116 of side walls 106 (FIGS. 2-3A).

Figure 4:
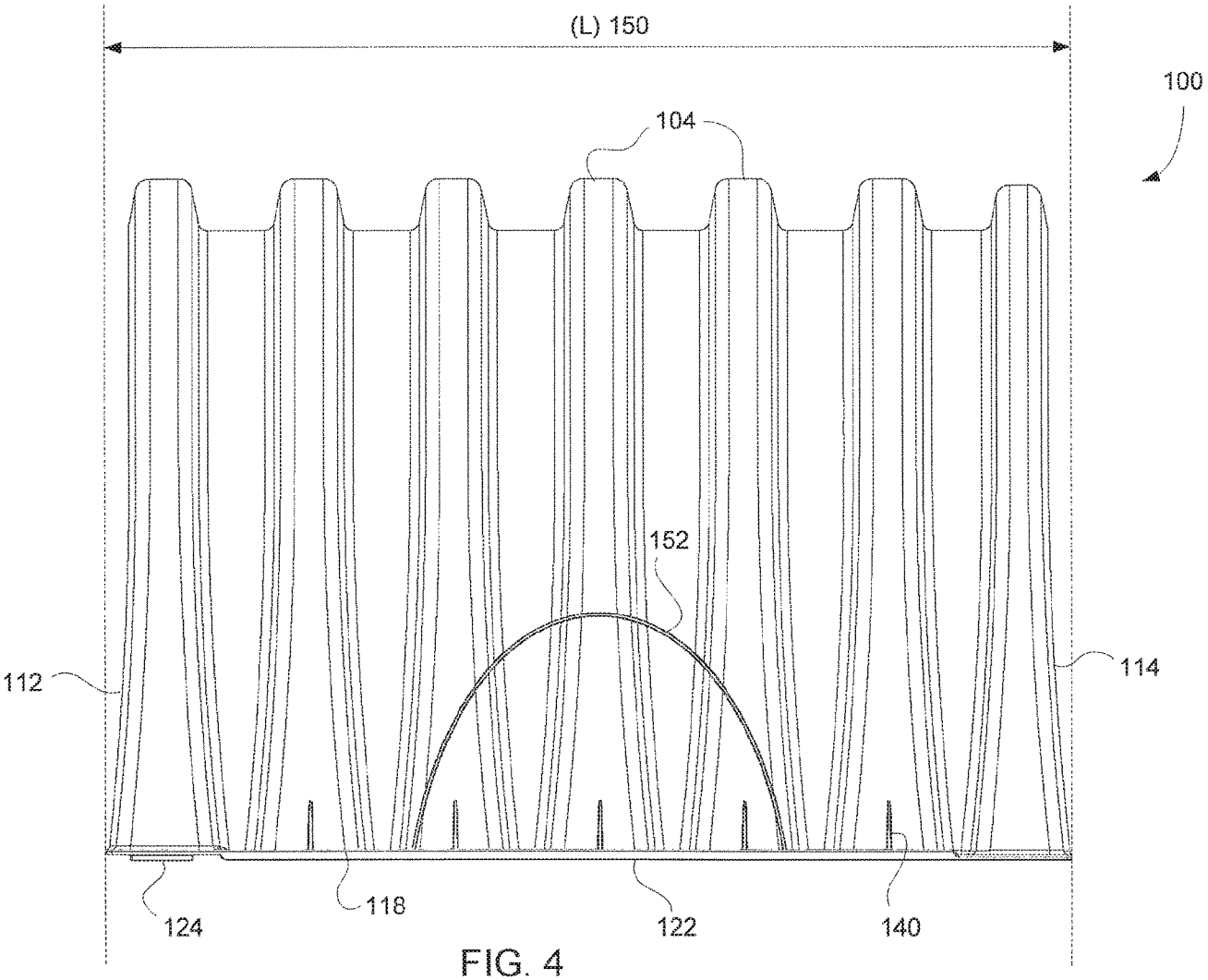
FIG. 4 is a left side elevational view of the storm water chamber according to FIG. 1.
Figure 5:
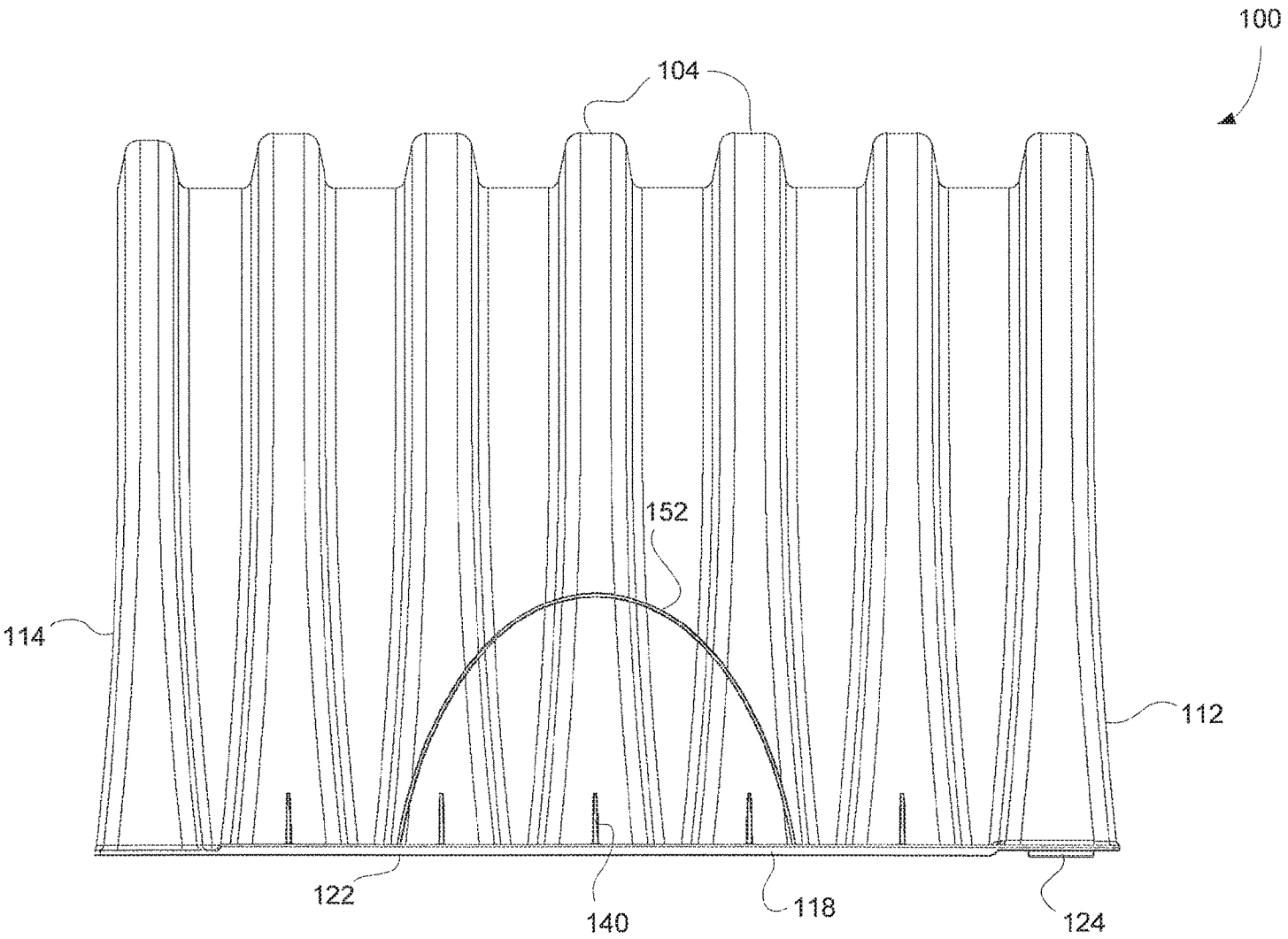
FIG. 5 is a right side elevational view of the storm water chamber according to FIG. 1.

Also shown in FIG. 1 is a cut-out line 152 provided on a lateral side of the chamber 100 (also shown in FIGS. 4 & 5). It is contemplated that the section defined by the cut-out line 152 can be removed and a connection piece can be laterally inserted into the side of chamber 100, which can be used to laterally connect rows of chambers 100 to create a storm water detention system as is known in the art.

Figure 1A:
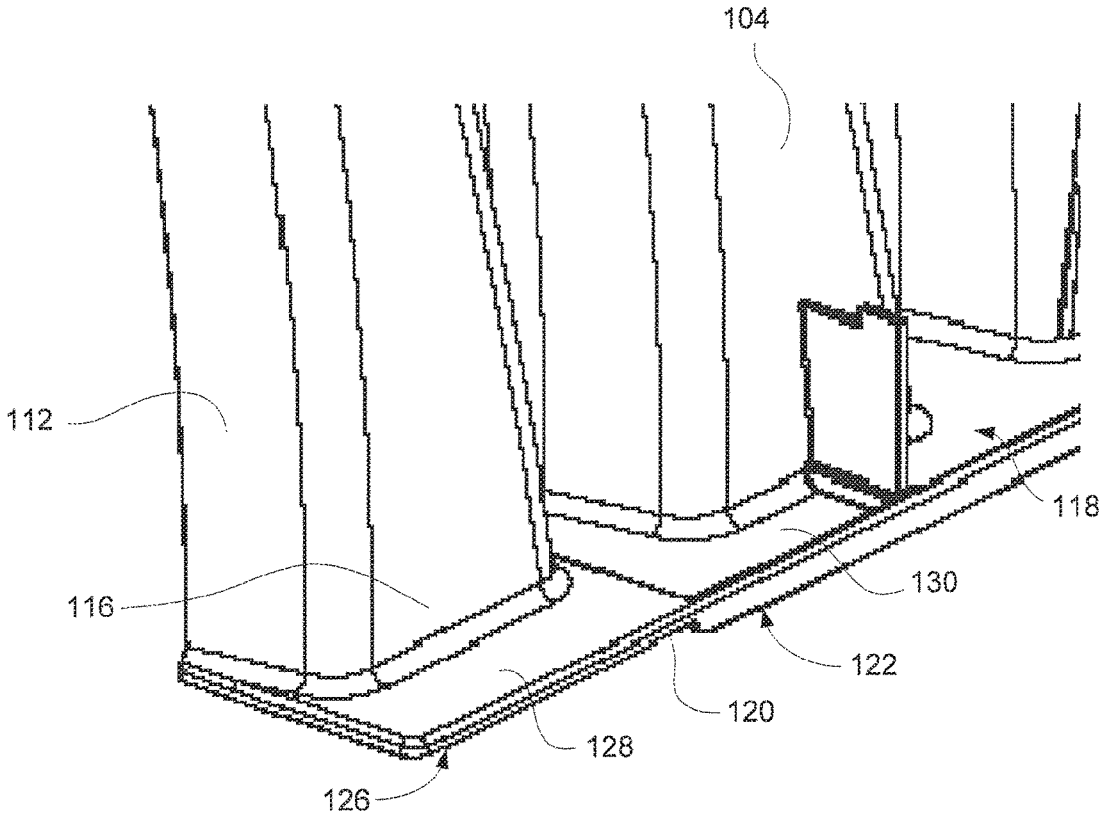
FIG. 1A is an enlarged perspective view of the first end of the chamber according to FIG. 1.
Figure 4A:
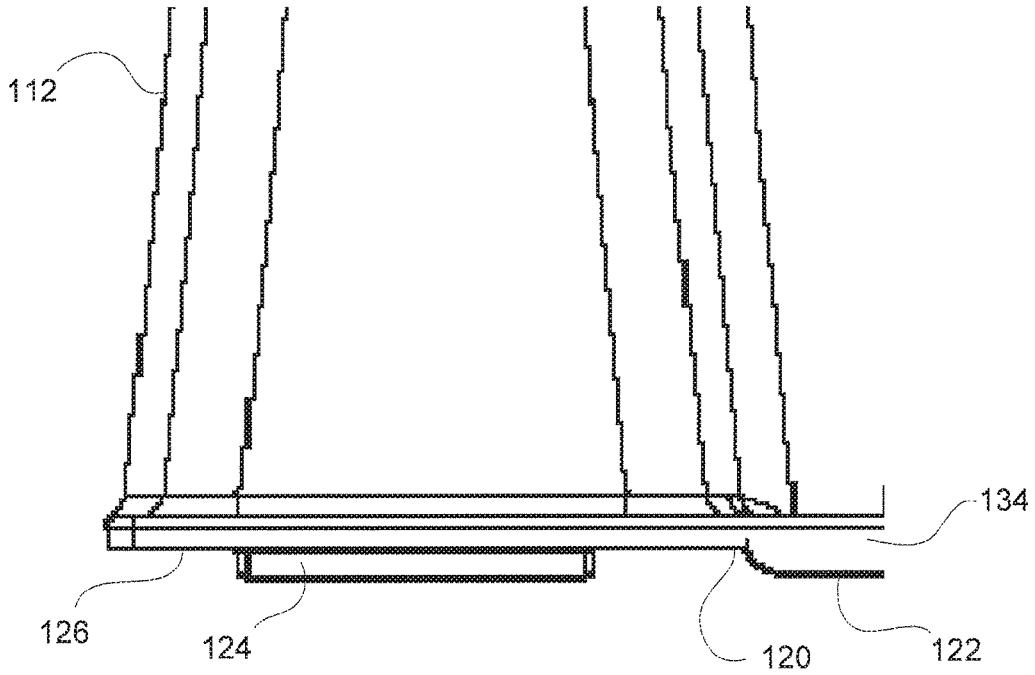
FIG. 4A is an enlarged perspective view of the first end of the chamber according to FIG. 4.

FIGS. 1A and 4A are enlarged views of one side of the first end 112 of the chamber 100. In particular, the end portion of flange 118 is illustrated. Flange 118 is provided with an undercut 120 positioned on a bottom surface 122 of flange 118. A protrusion 124 is positioned on and underside 126 of undercut 120. As can be seen in the Figures, an upper surface 128 is provided offset from an upper surface 130 of flange 118. When installed in an end-to-end fashion, the undercut 120 provides an offset to the flange so that the underside 126 of undercut 120 will sit over top of upper surface 130 of flange 118 of an adjacent chamber allowing the bottom surface 122 of flange 118 to sit flush on a surface.

Figure 1B:
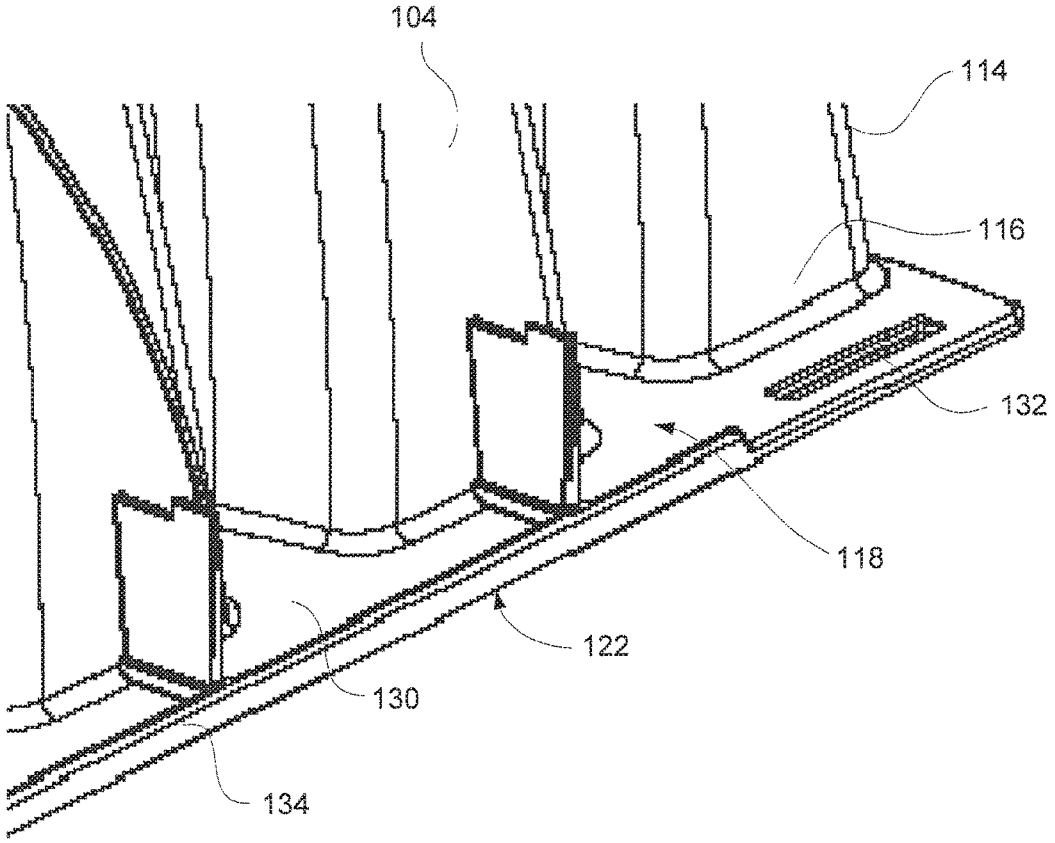
FIG. 1B is an enlarged perspective view of the second end of the chamber according to FIG. 1.
Figure 4B:
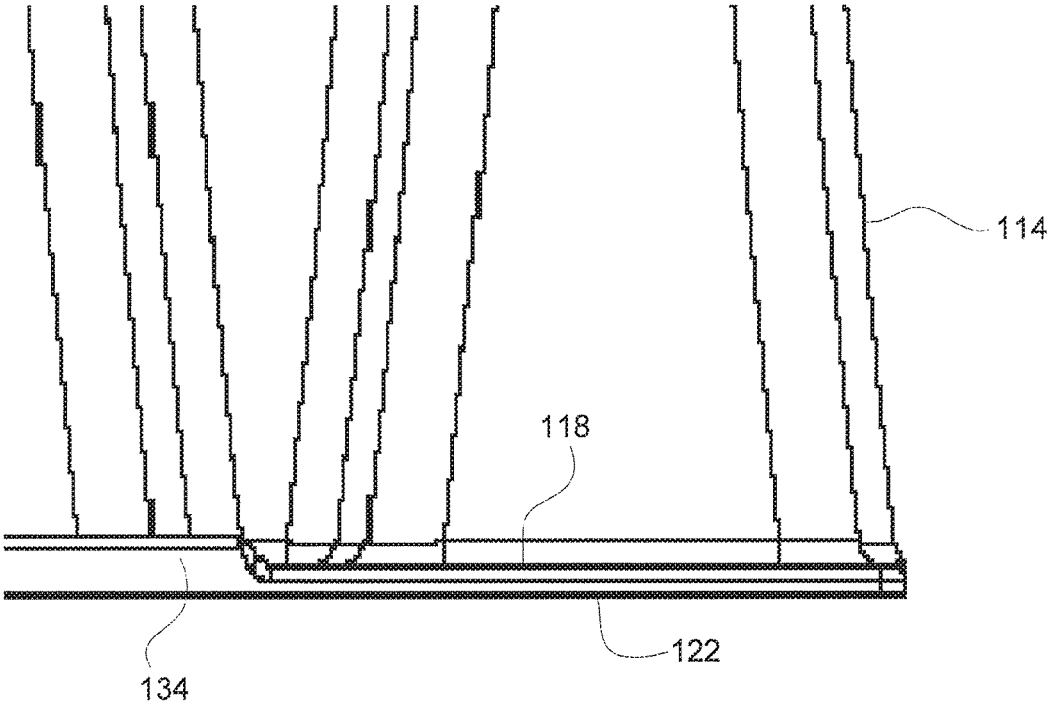
FIG. 4B is an enlarged perspective view of the second end of the chamber according to FIG. 4.

FIGS. 1B and 4B are enlarged views of one side of the second end 114 of the chamber 100 corresponding to an opposite end of flange 118 from FIGS. 1A and 4A respectively. As can be seen, an aperture (an opening extending through the flange) or a cavity (and opening in the flange which is closed at its bottom) 132 is provided extending through flange 118. The aperture or cavity 132 is provided as an elongated slot but could comprise virtually any configuration as desired. The aperture or cavity 132 is designed to receive protrusion 124 of an adjoining chamber 100. A raised portion 134 is provided along an outer edge of flange 118. However, it can be seen in FIG. 1B that the raised portion 134 terminates a distance short of second end 114. This allows an adjoining chamber to fit over the top of the upper surface 130 of flange 118. When referencing FIGS. 1A, 1B, 4A and 4B it can be seen that the undercut 120 would fit over top of the second end 114 of flange 118 such that the protrusion 124 would be received into aperture or cavity 132. In the examples shown in FIGS. 3A and 4A, the protrusion 124 comprises an elongated linear member that would secure into aperture (slot) or cavity 132.

Figure 3B:
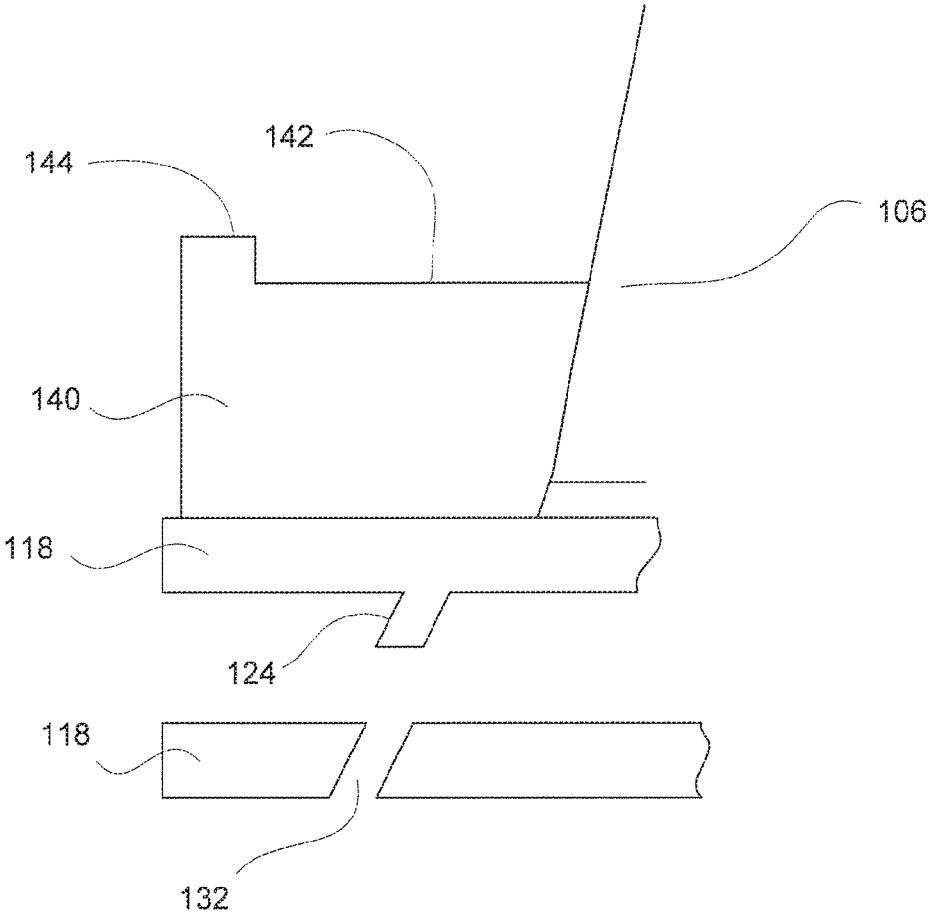
FIG. 3B is an alternative construction for the protrusion and aperture or cavity according to FIG. 3.
Figure 3C:
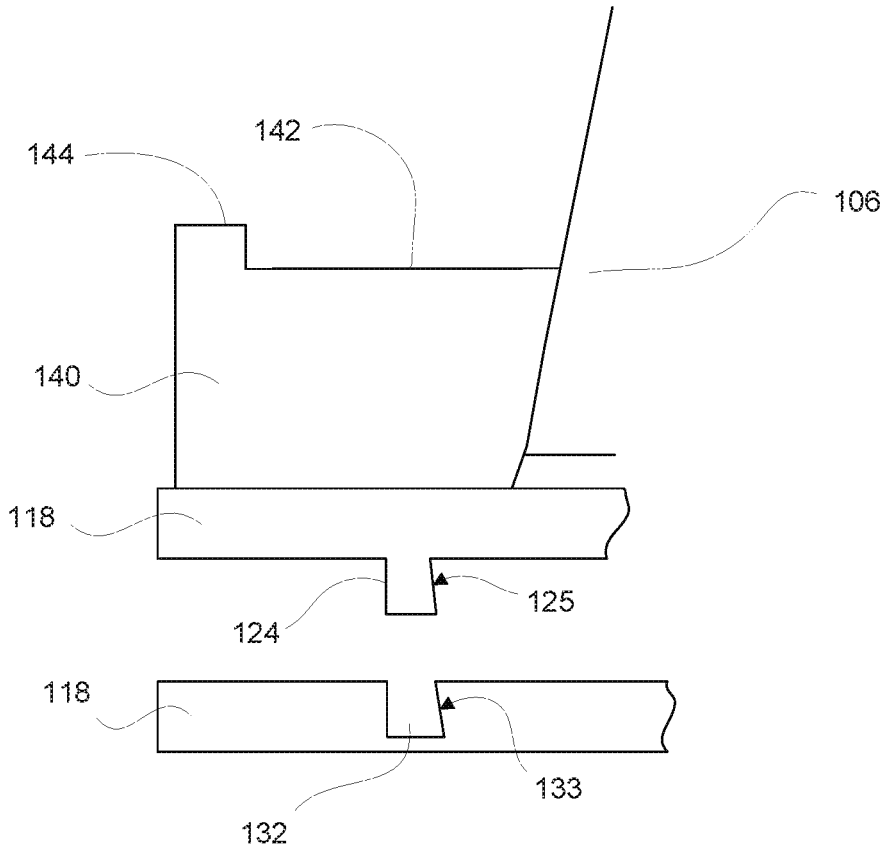

In practice, the protrusion 124 could friction fit with the aperture (slot) or cavity 132. Alternatively, protrusion 124 could be provided with an undercut 125 as seen in FIG. 30, that once pressed through aperture (slot) or cavity 132, could engage with an underside 133 of the aperture (slot) or cavity 132 to "lock" the protrusion 124 into aperture (slot) or cavity 132. Still further, the protrusion 124 could be provided as an angled member and the aperture (slot) or cavity 132 could be angled to receive the protrusion 124 (FIG. 3B). In this configuration, the angled protrusion 124 and matching aperture (slot) or cavity 132 could be provided on one side of the chamber, and the second side of the chamber could have a more vertically oriented protrusion 124 and aperture (slot) or cavity 132, and the first side of the chamber could be connected first and then the second side could be connected second.

In the preferred embodiment, one or more protrusions extend downwardly from the lower surface of the flange at the first end of a chamber, and one or more apertures or cavities having upwardly facing openings on the upper surface of the flange at the second end of the chamber. However, it is possible to construct chambers and systems in accordance with the invention with reversed positioning thereof, e.g., one or more protrusions extend upwardly from the upper surface of the flange at the first end of a chamber, and one or more apertures or cavities having downwardly facing openings on the lower surface of the flange at the second end of the chamber.

wherein the upper surface of said flange at the second end includes an aperture or cavity formed therein; and In practice; to connect two chambers 100 in an end-to-end configuration, a user would need to place the starting corrugation 108 of a first chamber over the end corrugation 110 of a second chamber. To secure the first chamber to the second chamber, the user could simply step on (apply pressure to) the upper surface 128 of flange 118; which would function to press the protrusion downward and through cavity (slot) 132. The undercut 120 of the first chamber would allow the two chambers to sit substantially flush on the surface.

FIG. 2 is an end view of second end 114 of chamber 100 while FIG. 3 is an end view of first end 112 of chamber 100. FIG. 3A shows an enlarged view of first end 112 including a stacking lug 140 that extends from the lower end 116 of side walls 106 to the upper surface 130 of flange 118. The stacking lug 140 is provided integrally formed with chamber 100.

An upper edge of the stacking lug 140 is divided into a first surface 142 and a second surface 144, which can also be seen in FIG. 1A. The first surface 142 extends from an outer surface of corrugation 104 and extends outward from the corrugation 104. The first surface 142 is provided substantially parallel with the flange 118 and is positioned a distance (d1) 146 from the flange 118. The second surface 144 is also provided substantially parallel with the flange 118 and is positioned a distance (d2) 148 from the flange 118. It can be seen in FIG. 3A that distance (d2) 148 is larger than distance (d1) 146.

In function, the stacking lug 140 is provided as a plurality of stacking lugs; in this example, five along each side of a length of the chamber 100.

As previously described, during storage and transit it is common that chambers 100 are stacked one on top of the other to conserve space and allow for more efficient storage and shipping. However, the chambers 100 can become tightly stuck to each other as the corrugations 104 become nested to each other over time. The stacking lugs 140 prevent the chambers 100 from becoming stuck because the underside 122 of flange 118 of the upper chamber will rest on the top of the stacking lug 140 of the lower chamber 100. This configuration allows the chambers 100 to be stacked one on top of the other, but still allows for the chambers 100 to easily be unstacked from each other when needed.

Figure 7:
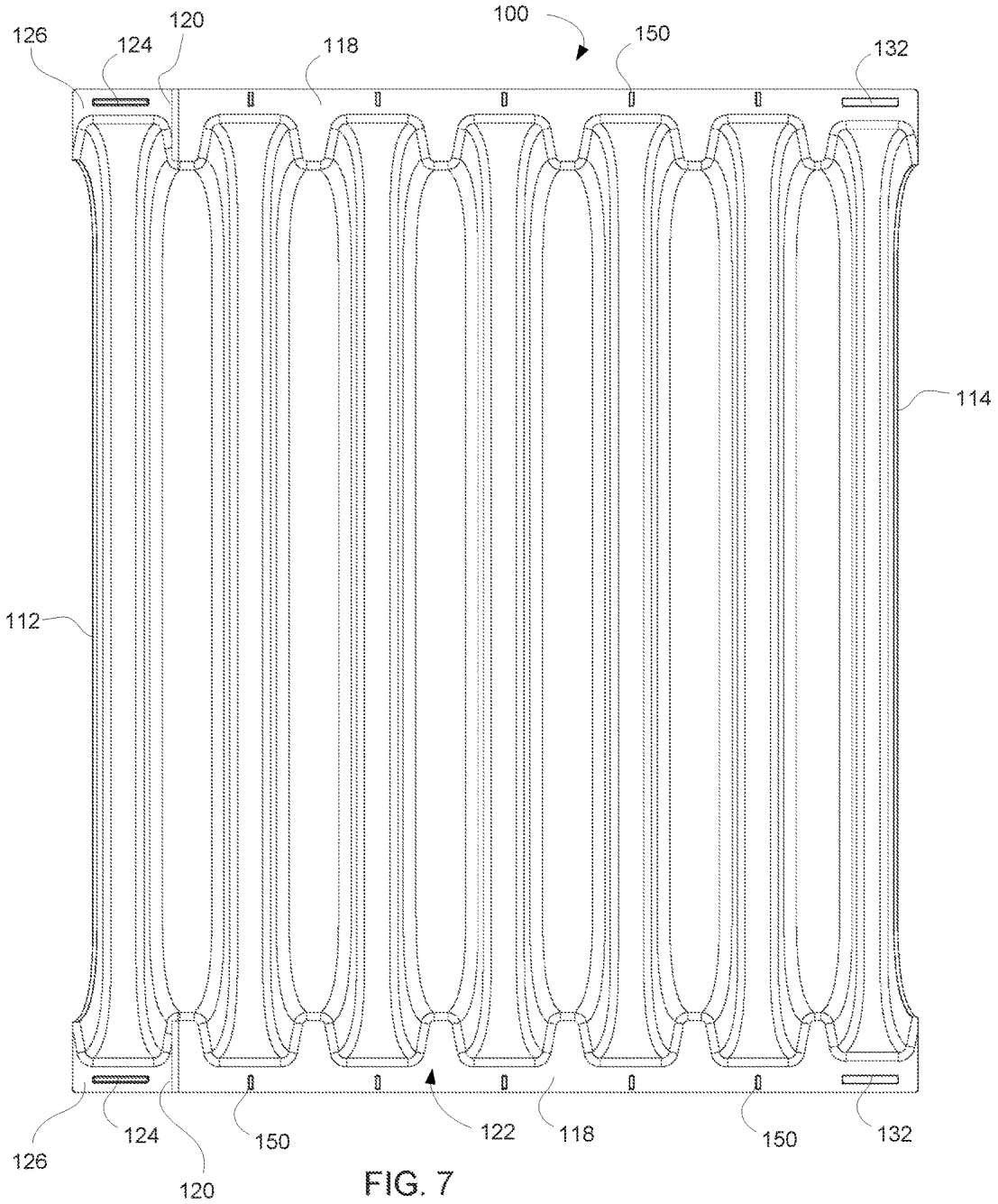
FIG. 7 is a bottom plan view of the storm water chamber according to FIG. 1.

This configuration is further illustrated in FIG. 7, which shows a bottom view of chamber 100. As can be seen with reference to the drawing, indentions 150 are located in the bottom surface 122 of flange 118. These indentions 150 correspond to the second surfaces 144 such that, when a first chamber 100 is stacked over top of a second chamber 100 the second surfaces 144 the second chamber engage with the indentions 150 of the first chamber. This functions to prevent any lateral shifting (sideways or longitudinal) of the chambers 100 relative to each other during transit as the weight of many chambers stacked one on top of the other can be considerable. The indentations 150 function to fix the stacked chambers to each other such that undue shifting of the load during transit does not occur.

Chamber 100 is most preferably a cellular plastic material formed through a blow molding process. A method of manufacturing a chamber 100, comprises the steps of: providing a polymer melt which can be a single polymer or a copolymer blend, then injecting the polymer melt and CO2 blowing agent blend into a mold cavity. The mold cavity defines the plastic arch-shaped corrugated chamber 100 having a plurality of corrugations 104 distributed along a length of the chamber 100, and forming a flange 118 as previously described.

In one system configuration, chamber 100 has an axial length of 1.25 meters, a width of 1.981 meters, and a height of 1.219 meters, and provides a storage volume for collected water of 1.84 $m^3$/unit.

Other objects of the present invention are achieved by providing the mold cavity defining an arch-shaped corrugated chamber having a top portion and two side portions, with a base at a lower end of each side portion, the chamber length defined by a first end and a second end, the mold cavity further defining a flange provided at the base of each lower end of each side portion, said flange extending substantially perpendicular to the lower end of each side portion and having an upper surface and a lower surface with the lower surface of said flange at the first end including a protrusion and the upper surface of said flange at the second end including a cavity formed therein.

Although the invention has been described with reference to a particular arrangement of parts, features and the like, these are not intended to exhaust all possible arrangements or features, and indeed many modifications and variations will be ascertainable to those of skill in the art.

What is claimed is:

1. A water detention system, comprising:

a first plastic arch-shaped corrugated chamber having corrugations distributed along a length of the chamber extending transverse to a longitudinal axis of the chamber, the chamber having a top portion and two side portions, with a base at a lower end of each side portion, the chamber length defined by a first end and a second end; and a first flange provided at the base of each lower end of each side portion of said first plastic arch-shaped corrugated chamber, said first flange extending substantially perpendicular to the lower end of each side portion and having a first upper surface and a first lower surface;

wherein the first lower surface of at least one of said first flanges at the first end includes a first protrusion formed as an elongated member;

wherein the first upper surface of at least one of said first flanges at the second end includes a first aperture or cavity formed therein as an elongated slot; and a second plastic arch-shaped corrugated chamber having corrugations distributed along a length of the chamber extending transverse to a longitudinal axis of the chamber, the chamber having a top portion and two side portions, with a base at a lower end of each side portion, the chamber length defined by a first end and a second end; and a second flange provided at the base of each lower end of each side portion of said second plastic arch-shaped corrugated chamber, said second flange extending substantially perpendicular to the lower end of each side portion and having a second upper surface and a second lower surface;

wherein the second lower surface of at least one of said second flanges the first end includes a second protrusion formed as an elongated member;

wherein the second upper surface of at least one of said second flanges at the second end includes a second aperture or cavity formed therein as an elongated slot; and wherein the first and second chambers are affixed to each other in an end-to-end fashion, a first upstanding end corrugation of the first chamber fitted over top of a second upstanding end corrugation of the second chamber such that the second upstanding end corrugation is nested within the first upstanding end corrugation, wherein said first protrusion is fitted into and engages with said second aperture or cavity such that the two side portions of the first plastic arch-shaped corrugated chamber are prevented from moving laterally away from the two side portions of the second plastic arch-shaped corrugated chamber.

2. The system of claim 1, wherein the elongated member and the elongated slot extend parallel to the longitudinal axis of each respective chamber.

3. The system of claim 2, wherein said at least one of said first flanges is provided with an undercut on the lower surface with said first protrusion positioned on said undercut.

4. The system of claim 1, wherein the first protrusion comprises two first protrusions and the second protrusion comprises two second protrusions, the two first protrusions positioned on the lower surfaces of the first flanges and the two second protrusions positioned on the lower surfaces of the second flanges, and the first aperture or cavity comprises two first apertures or cavities and the second aperture or cavity comprises two second apertures or cavities, the two first apertures or cavities positioned on the upper surfaces of said two first flanges and the two second apertures or cavities positioned on the upper surfaces of said second flanges.

5. The system of claim 4, wherein the two first elongated members and the two first elongated slots extend parallel to the longitudinal axis of said first chamber.

6. The system of claim 5, wherein one of said first two elongated members is angled relative to a longitudinal length of its respective flange and one of said first elongated slots is angled relative to a longitudinal length of its respective flange and is adapted to receive an angled elongated member.

7. The system of claim 1, wherein said first protrusion is sized to friction fit within said second aperture or cavity.

8. The system of claim 1, wherein said first protrusion has an undercut and is adapted to be inserted into said second aperture or cavity whereby the first protrusion is locked into the second aperture or cavity.

9. The system of claim 1, wherein the second end corrugation of the second chamber is smaller than the first end corrugation of the first chamber.

10. The system of claim 1, further comprising first stacking lugs extending between said at least some of the corrugations and said respective flange of said first plastic arch-shaped corrugated chamber.

11. The system of claim 10, wherein said stacking lugs form an upper edge that extends substantially perpendicular to the longitudinal axis of said first plastic arch-shaped corrugated chamber.

12. The system of claim 11, wherein said upper edge comprises a first surface in a plane a first distance (d1) from the upper surface of said first flange and a second surface in a plane a second distance (d2) from the upper surface of said first flange.

13. The system of claim 12, wherein the second distance (d2) is larger than the first distance (d1).

14. The system of claim 1, wherein said first plastic arch-shaped corrugated chamber is formed of a cellular plastic foam.

15. A water detention chamber, comprising:

a plastic arch-shaped corrugated chamber having corrugations distributed along a length of the chamber extending transverse to a longitudinal axis of the chamber, the chamber having a top portion and two side portions, with a base at a lower end of each side portion, the chamber length defined by a first end and a second end;

said first end comprising a upstanding starting corrugation and said second end comprising an upstanding end corrugation, wherein the starting corrugation is designed to mate with and nest within an end corrugation on an identical second water detention chamber such that the water detention chamber and the second water detention chamber are non-rotatable relative to each other when connected in an end-to-end fashion; and a flange provided at the base of each lower end of each side portion, said flanges extending substantially perpendicular to the lower end of each side portion and having an upper surface and a lower surface;

wherein the flanges are provided with one or more protrusions extending downwardly from the lower surface of said flange at the first end;

wherein the flanges are provided with one or more apertures or cavities having an opening at the second end, whereby the one or more protrusions extend in a direction opposite from an orientation of the opening of the one or more apertures or cavities;

wherein said one or more protrusions on said chamber are adapted to fit into and engage with one or more mating apertures or cavities on an identical second chamber such that the two side portions of the chamber are prevented from moving laterally away from two side portions of the second chamber.

16. The chamber of claim 15, wherein said one or more protrusions comprise one or more elongated members and said one or more apertures or cavities comprise one or more elongated slots.

17. The chamber of claim 16, wherein the one or more elongated members and the one or more elongated slots extend in parallel with the longitudinal axis of said chamber.

18. The chamber of claim 15, wherein the one or more protrusions are provided with an undercut.

19. A water detention system, comprising:

a first plastic arch-shaped corrugated chamber having corrugations distributed along a length of the chamber extending transverse to a longitudinal axis of the chamber, the chamber having a top portion and two side portions, with a base at a lower end of each side portion, the chamber length defined by a first end and a second end; and a first flange provided at the base of each lower end of each side portion of said first plastic arch-shaped corrugated chamber, said first flange extending substantially perpendicular to the lower end of each side portion and having a first upper surface and a first lower surface;

wherein the first lower surface of at least one of said first flanges at the first end includes a first protrusion formed as an elongated member;

wherein the first upper surface of at least one of said first flanges at the second end includes a first aperture or cavity formed therein as an elongated slot; and a second plastic arch-shaped corrugated chamber having corrugations distributed along a length of the chamber extending transverse to a longitudinal axis of the chamber, the chamber having a top portion and two side portions, with a base at a lower end of each side portion, the chamber length defined by a first end and a second end; and a second flange provided at the base of each lower end of each side portion of said second plastic arch-shaped corrugated chamber, said second flange extending substantially perpendicular to the lower end of each side portion and having a second upper surface and a second lower surface;

wherein the second lower surface of at least one of said second flanges at the first end includes a second protrusion formed as an elongated member;

wherein the second upper surface of at least one of said second flanges at the second end includes a second aperture or cavity formed therein formed as an elongated slot; and wherein the first and second chambers are affixed to each other in an end-to-end fashion, a first end corrugation of the first chamber fitted over top of a second end corrugation of the second chamber such that the second end corrugation is nested within the first end corrugation, wherein said first protrusion is fitted into and engages with said second aperture or cavity such that the two side portions of the first plastic arch-shaped corrugated chamber are prevented from moving laterally away from the two side portions of the second plastic arch-shaped corrugated chamber;

wherein the first protrusion comprises two first protrusions and the second protrusion comprises two second protrusions, the two first protrusions positioned on the lower surfaces of the first flanges and the two second protrusions positioned on the lower surfaces of the second flanges, and the first aperture or cavity comprises two first apertures or cavities and the second aperture or cavity comprises two second apertures or cavities, the two first apertures or cavities positioned on the upper surfaces of said first flanges and the two second apertures or cavities positioned on the upper surfaces of said second flanges;

wherein the two first elongated members and the two first elongated slots extend parallel to the longitudinal axis of said first chamber;

wherein one of said first two elongated members is angled relative to a longitudinal length of its respective flange and one of said first elongated slots is angled relative to a longitudinal length of its respective flange and is adapted to receive an angled elongated member.

* * * * *